United States Patent [19]

Voigt et al.

[11] Patent Number: 5,035,376

[45] Date of Patent: Jul. 30, 1991

[54] ACTIVELY DAMPED STEERING RATE SENSOR FOR ROTATING AIRFRAME AUTOPILOT

[75] Inventors: Allan A. Voigt, Anaheim; Kenneth C. York, Pomona; John M. Speicher, Upland, all of Calif.

[73] Assignee: General Dynamics Corp., Pomona Division MZ 1-25, Pomona, Calif.

[21] Appl. No.: 282,834

[22] Filed: Jul. 31, 1981

[51] Int. Cl.[5] ..... F41G 7/00; G01P 9/02

[52] U.S. Cl. ..... 244/3.21; 73/504

[58] Field of Search ..... 244/3.15, 3.2, 3.21, 244/3.23; 73/504, 505, 517 R, 517 A, 518, 526

[56] References Cited

U.S. PATENT DOCUMENTS

| | | | |
|---|---|---|---|
| 2,519,459 | 8/1950 | Hanna et al. | 74/5.5 |
| 2,822,694 | 2/1958 | McKenney | 74/5 R |
| 2,948,155 | 8/1960 | Burkam | 74/5.6 |
| 3,075,393 | 1/1963 | Lindgren | 74/5.34 |
| 3,079,803 | 3/1963 | Möller | 74/5.5 |
| 3,115,326 | 12/1963 | Barriger | 248/358 |
| 3,252,339 | 5/1966 | Huang | 74/5.6 |
| 3,443,321 | 5/1969 | Auer | 33/226 |
| 3,577,646 | 5/1971 | Eklund | 33/226 |
| 3,664,175 | 5/1972 | Pierson | 73/517 R |
| 3,786,685 | 1/1974 | Lademann et al. | 74/5.5 |
| 4,037,806 | 7/1977 | Hirsch et al. | 244/3.16 |
| 4,054,254 | 10/1977 | Cole | 244/3.21 |
| 4,114,451 | 9/1978 | Crittenden et al. | 73/504 |
| 4,114,452 | 9/1978 | Bitson | 73/504 |
| 4,114,769 | 3/1979 | Mayer | 74/5.5 |
| 4,159,502 | 6/1979 | Mayer | 361/140 |
| 4,168,813 | 9/1979 | Pinson et al. | 244/3.15 |
| 4,189,947 | 2/1980 | Friedland | 74/5.5 |
| 4,224,573 | 9/1980 | Brook | 73/505 |

FOREIGN PATENT DOCUMENTS

| | | | |
|---|---|---|---|
| 0007583 | 6/1980 | European Pat. Off. | 73/517 A |
| 1294691 | 5/1969 | Fed. Rep. of Germany . | |

*Primary Examiner*—Charles T. Jordan

*Attorney, Agent, or Firm*—Neil Martin; Leo R. Carroll

[57] ABSTRACT

An actively damped steering rate sensing device for an autopilot control system capable of producing angular rotation in a control plane of an intentionally continuously axially rolling airframe such as a homing missile in response to a rotation related guidance command signal. The device includes an elongated armature member mounted to the airframe for pivotal movement about an axis extending through the member intermediate its length. The pivot axis is oriented with respect to the rotational axis of the airframe so that the armature member will pivot by gyroscopic precession in response to rotation in the control plane of the rolling airframe. Sensing and damping coils are mounted on opposite ends of the armature member. Magnets and flux path return elements are fixedly mounted adjacent each of the coils. Movement of the armature member during flight produces an output signal in the sensing coil which is amplified and applied in the correct phase to the damping coil to damp the pivotal motion of the armature member.

16 Claims, 3 Drawing Sheets

ACTIVELY DAMPED STEERING RATE SENSOR FOR ROTATING AIRFRAME AUTOPILOT

BACKGROUND OF THE INVENTION

The present invention relates to control mechanisms for rotating airframes, and more particularly, to a steering rate sensing device and active damping circuit for use in an autopilot control system which directs the flight path maneuvers of a rolling missile.

Many missiles have been designed for intentionally induced and maintained roll rates about their longitudinal axis during flight. Such missiles have significant practical advantages over roll stabilized airframes. This rolling airframe concept has been applied to both air and surface launched missiles. These missiles can be spun initially by the launcher and utilize control surfaces to maintain a predetermined rate of roll. With a roll rate of approximately 5 to 10 revolutions per second, it is possible to utilize a single control plane to guide the missile in all three earth related axes.

In a typical application of this concept, as disclosed in U. S. Pat. No. 4,037,806, the control system utilizes a single pair of variable incidence control surfaces to steer the missile about the control plane at a selected instantaneous rotational orientation upon command from a guidance command signal. Thus, with such a missile operating in a level flight attitude, to cause the missile to climb, a guidance command signal must vary in amplitude at a frequency equal to the roll rate of the missile. For example, in the vertical plane, the guidance command signal would be a generally sinusoidal wave form that would induce pitch-up as the control plane of the vehicle approaches earth vertical and pitch-down after the control surface rotates and nearest a one-half revolution from pitch-up, thereby producing upward change in the angle of attack. The angle of attack produces a body lift and alters the missile course from a horizontal to a climbing course. Similarly, a course change to the right would be effected by a sinusoidal signal displaced 90° from the signal required for a vertical course change. This provides a simplified control system resulting in a reduction in cost and an increase in reliability for rolling airframes in contrast with stabilized airframes.

The present invention was conceived and developed for utilization in a recently developed autopilot control system for rolling airframes which is disclosed in U.S. Pat. No. 4,054,254. In such a control system, it is desirable to produce a damping of the commanded wing incidence to prevent overshoot.

In U. S. Pat. No. 4,054,254 mentioned above, the steering rate sensing device includes a pivotally mounted magnetic flapper surrounded by an inductive pick-off assembly. The flapper is immersed within a damping fluid. Since the sensing device rotates with the airframe, a gyroscopic effect is produced on the flapper which in conjunction with the damping fluid stabilizes the position of the magnetic flapper, and therefore a zero output is produced by the inductive pick-off assembly. However, when action of the control surfaces causes the airframe to pitch in the control plane, the angular velocity of that pitching movement determines the degree to which the flapper will precess. This causes the magnetized flapper to approach the inductive pick-off assembly and produce a signal output corresponding to the angular velocity on pitch rate. The output of the pitch rate sensing device is summed with the undamped control signal to produce a damped control signal. This prevents overshoot.

Steering rate sensing devices which may be utilized in the autopilot control system of the aforementioned U.S. Pat. No. 4,054,254 are disclosed in U.S. Pat. Nos. 4,114,451 and 4,114,452. These devices may also be fluid damped.

In prior steering rate sensing devices, the degree of damping of the rotor, i.e., the damping coefficient, must be carefully controlled to achieve missile flight path accuracy. This is because the output of such steering rate sensing devices is proportional to the damping. Prior steering rate sensing devices have been subject to large variations in output with changes in temperature. This is due to fluid viscosity changes in the case of fluid damped devices and due to changes in resistivity in the case of electromagnetically damped devices.

SUMMARY OF THE INVENTION

It is therefore the primary object of the present invention to overcome the above problems of the prior art.

Another object of the present invention is to provide an improved steering rate sensing device for use in rolling airframe autopilot control systems.

Another object of the present invention is to provide an actively damped steering rate sensing device for use in the autopilot control system of a rolling airframe.

The present invention provides an actively damped steering rate sensing device for an autopilot control system capable of producing angular rotation in a control plane of an intentionally continuously axially rolling airframe such as a homing missile in response to a rotation related guidance command signal. The device includes an elongated armature member mounted to the airframe for pivotal movement about an axis extending through the member intermediate its length. The pivot axis is oriented with respect to the rotational axis of the airframe so that the armature member will pivot by gyroscopic precession in response to rotation in the control plane of the rolling airframe. Sensing and damping coils are mounted on opposite ends of the armature member. Magnets and flux path return elements are fixedly mounted adjacent each of the coils. Movement of the armature member during flight produces an output signal in the sensing coil which is amplified and applied in the correct phase to the damping coil to damp the pivotal motion of the armature member.

BRIEF DESCRIPTION OF THE DRAWINGS

The above and other objects and advantages of the prevent invention will become apparent when read in conjunction with the drawings, wherein.

DETAILED DESCRIPTION OF A PREFERRED EMBODIMENT

Figure 1:
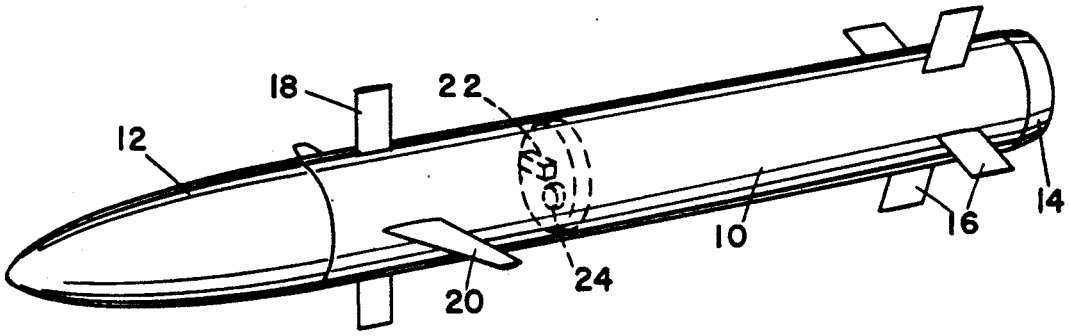
FIG. 1 is a perspective view of a typical missile incorporating the actively damped steering rate sensing device of the present invention.

Turning now to FIG. 1 of the drawings, a typical example of a rolling airframe is illustrated in the form of a missile. The airframe comprises a generally elongated cylindrical body 10, having an aerodynamically shaped nose 12 and a tail 14 from which thrust from a rocket engine or the like emerges. The body is provided with a plurality of roll inducing fins or surfaces 16 near the tail end thereof for inducing and/or maintaining a roll in the body about its longitudinal axis. The device is also provided with a pair of fixed canard surfaces 18 and a pair of variable incidence control canard surfaces 20. The canard surfaces 20 may be rotated to positive and negative angles of incidence by a suitable control system, such as disclosed in the aforementioned U.S. Pat. No. 4,054,254. The canard surfaces 20 control attitude in a plane passing through the longitudinal axis of the missile and perpendicular to the axis of rotation of the control surfaces 20. This plane is referred to as the control plane. References to up or down on the control plane are vehicle related directions. The control system for the airframe includes an angular rate or steering rate sensor 22 and an accelerometer 24 (FIGS. 1 and 2).

The roll inducing surfaces 16 together with an initial spin-up of the missile provided by the launcher induce a roll rate about the missile's longitudinal axis of approximately 10 revolutions per second. Steering control of the airframe is accomplished by varying the incidence of the control surfaces 20 in a cyclical manner to correspond to the instantaneous position of the control plane. For example, with the vehicle negotiating a horizontal flight path, if it is desired to cause the vehicle to be steered in a curved path to the left, the control surfaces 20 are given a positive angle of attack which is at a maximum when the up section of the control plane is in the left 180° of rotation. Ignoring control reaction delay, the positive incidence angle reaches a maximum as the control plane is at the earth related horizontal (the vehicle related up section of the control plane to the left). During the next 90° of rotation, the positive incidence of the control surfaces is reduced to zero and in the succeeding 90° of rotation is moved to a negative angle of attack reaching a maximum when the control plane is again horizontal with the vehicle related up section to the right. The movement of the control surfaces 20 corresponds to a sinusoidal variation with a frequency equal to the roll rate and with the relative phase determined by the direction of the desired correction.

Figure 2:
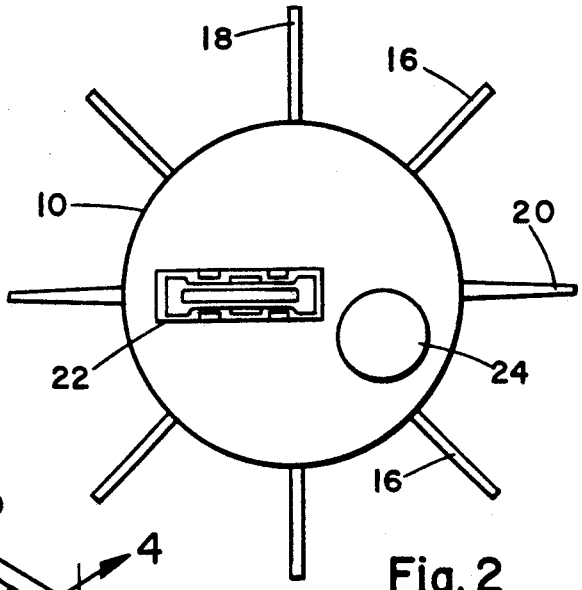
FIG. 2 is a diagrammatic cross sectional view of the missile of FIG. 1 showing the orientation of the steering rate sensing device within the missile.

Turning now to FIG. 2 of the drawings, the accelerometer 24 is mounted on the airframe with its sensitive axis lying in the control plane, but inverted relative to the airframe vertical. In this orientation, the accelerometer produces a signal corresponding to acceleration in the control plane, but with the opposite sense.

Figure 3:
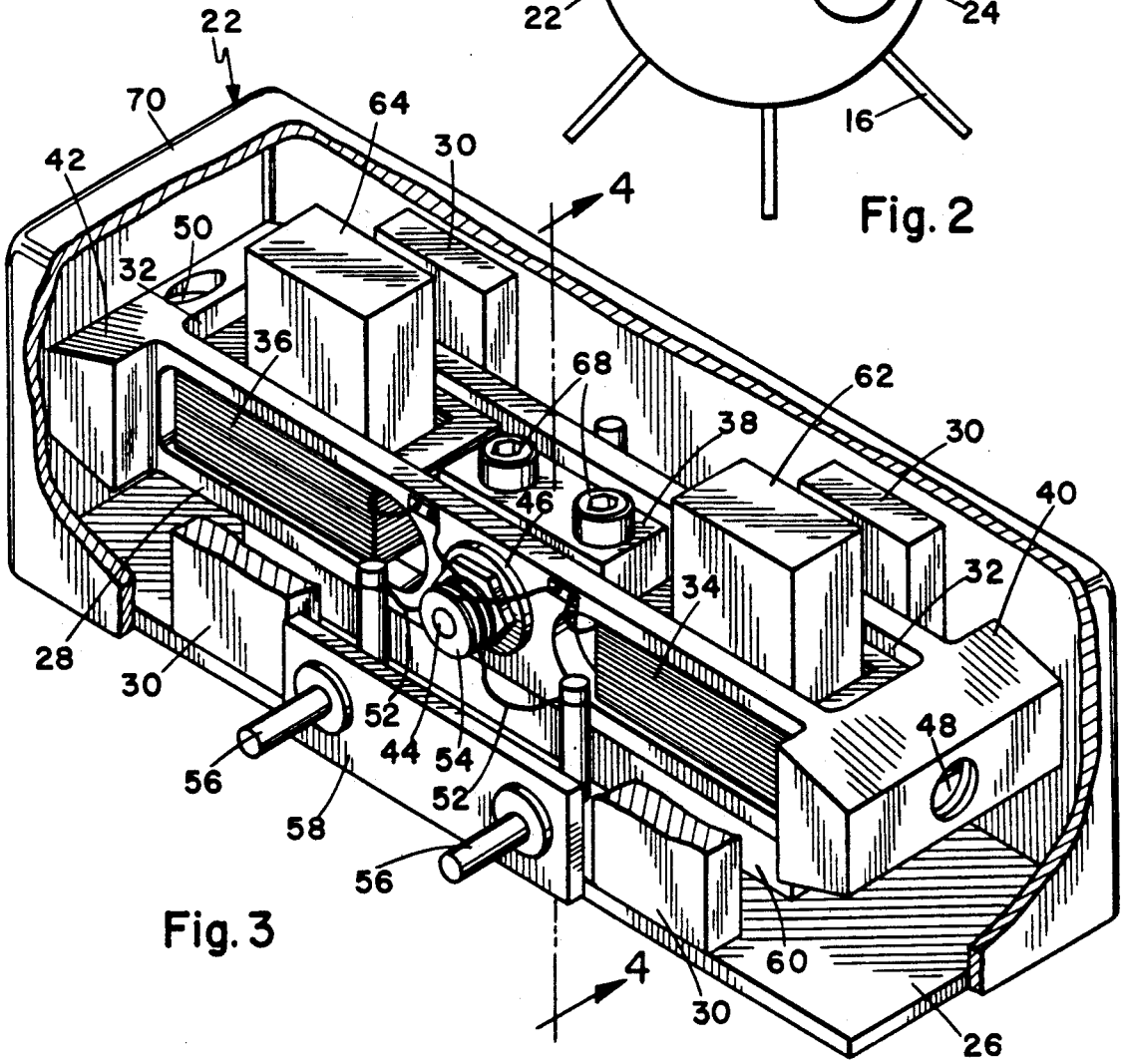
FIG. 3 is a fragmentary perspective view of the actively damped steering rate sensing device.
Figure 4:
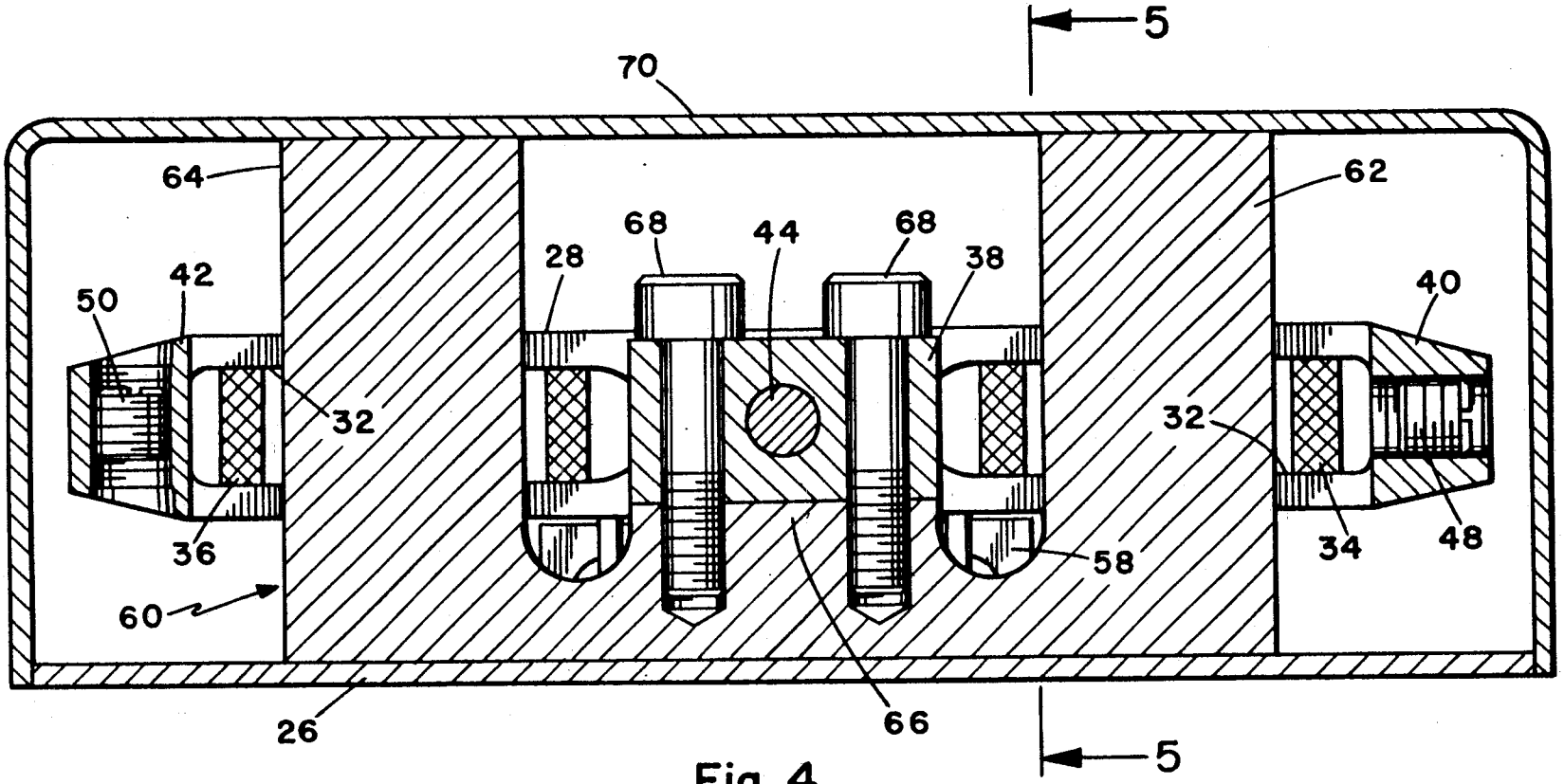
FIG. 4 is a sectional view taken on line 4—4 of FIG. 3.
Figure 5:
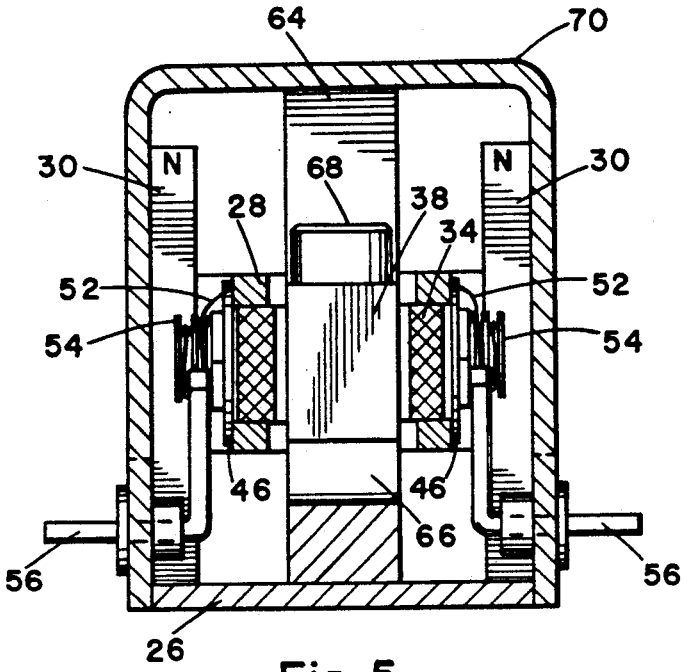
FIG. 5 is a sectional view taken on line 5—5 of FIG. 4.

Details of the angular rate of steering rate sensor 22 are illustrated in FIGS. 3–5. It includes a magnetically permeable base member 26 having suitable means (not shown), such as mounting screws and brackets for attachment to a rotating body, such as the rolling airframe of the missile. These screws permit the device to be rotated relative to the airframe for best phase although this phase can normally be fixed. A flapper or armature member 28 is pivotally mounted to the base 26 about an axis that is transverse to the rotary axis of the base. This armature member operates in a magnetic field provided by fixed magnets 30 mounted to the base member. This entire pivoted assembly constitutes what may be referred to as a rotor.

The armature member 28 is in the general configuration of an elongated bar or the like having generally rectangular cut-outs 32 for receiving a pair of coils 34 and 35 and a block 38. The armature member 28 has concentrated massive portions 40 and 42 at opposite ends, away from its pivot axis. A cylindrical pivot shaft 44 extends through the plane of the armature member intermediate its length and defines the pivot axis thereof. The pivot shaft extends through a hole in the block 38 and is journaled in precision bearings 46 mounted within bores in the armature member. A pair of retaining screws (not shown) permit adjustment and locking of the bearings in position. Although ball type bearings are preferred, other bearings or supports may be utilized, such as spring supports and/or jeweled bearings and the like. The armature member 28 is balanced about its rotational axis defined by the bearings 46 by a balance screw 48. The armature member is also balanced about its rotary axis coinciding with the rotary axis of the base member 26 by a balance screw 50. This axis again preferably coincides with the longitudinal or rotary axis of the rolling airframe. The device will generally perform satisfactorily with substantial offsets of the device rotary axis from the rotary axis of the rolling airframe. The balance screws 48 and 50 are threadably engaged in holes extending through the massive portions 40 and 42, respectively, of the armature member. These screws may be turned to precisely balance the device.

The coils 34 and 36 are made of a suitable conductive wire, such as copper wire, wound about a spool or bobbin or bonded so that they can fit into the cut outs 32 in the armature member. The turns of wire encircle axes which extend generally perpendicular to the pivot axis of the armature member 28.

Current in the coils is conducted by way of flexible leads 52 coiled around a bobbin 54 journaled on the pivot shaft 44. These leads are electrically connected to sealed feed through pin assemblies 56 supported by a flange 58 extending upwardly from the base member 26.

A magnetically permeable flux return path assembly 60 is mounted on the base member 26. It has a pair of vertical rectangular portions 62 and 64 which extend through the coils 34 and 36, respectively, adjacent corresponding ones of the magnets 30. The opposite sides of the armature member 28 and the coils carried thereby are not in physical contact with the return path portions or elements 62 and 64 and thus move freely up and down with respect thereto. The return path assembly further includes a central support portion 66 which is integrally connected to, and spaced between, the portions 62 and 64. The block 38 which carries the armature member pivot shaft 44 is mounted on top of the support portion 66 and is secured thereto by bolts 68. The portions 62 and 64 allow magnetic flux to pass from the magnets 30 through the sensing and damping coils 34 and 36. The entire assembly is enclosed by a cover 70 which may serve as a permeable magnetic return path as well as a support for the permanent magnets 30. This cover may be designed to be hermetically sealed.

Figure 6:
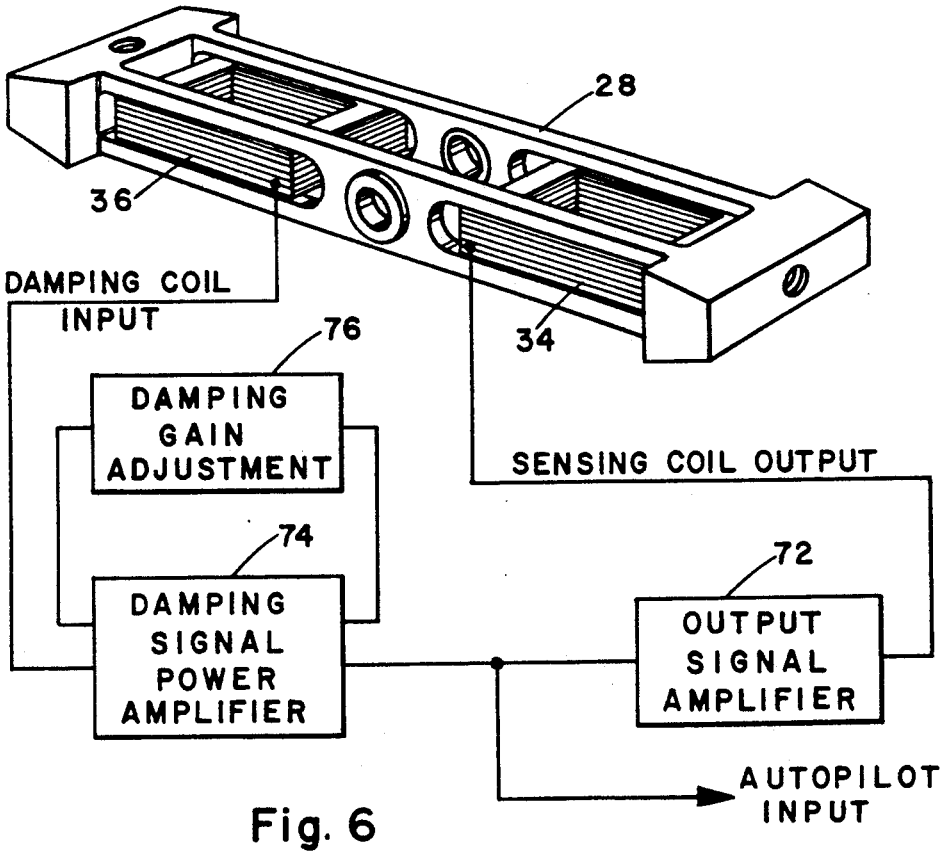
FIG. 6 is a block diagram of the steering rate sensing device and associated active damping circuitry.

The steering rate sensing drive 22 is actively damped utilizing active damping circuitry shown in FIG. 6. In flight, the pivotal motion of the armature member 28 causes a voltage to be generated in the sensing coil 34. This voltage is amplified by an electronic amplifier 72 for use by the rolling airframe autopilot control system. This amplified voltage is also used to drive a small power amplifier 74 which in turn drives the damping coil 36 on the opposite end of the armature member from the sensing coil 34. Because both the sensing coil and the damping coil are mounted to the same armature member, the voltages generated by these coils as they move through the magnetic flux, which is fixed to the missile axis, are in phase (zero degrees) or 180° out of phase, depending on the way the coil leads are connected. Therefore, by amplifying the output of the sensing coil and using it to drive the damping coil in such phase as to oppose or inhibit the pivotal motion of the armature member, damping can be achieved. The degree of damping can easily be varied by simply adjusting a gain control 76 connected to the amplifier 74.

This active damping system has significant advantages. The damping can be easily varied by simple electronic gain adjustments. In addition, the damping is not affected by the resistive changes of the coils due to temperature changes. This may be achieved if the amplifiers are current amplifiers. Because state of the art electronic power amps are low in cost, reliable, small and stable with temperature, they are preferred for this system. The only significant variation in the damping in the system described herein is attributable to the variation in the magnetic flux with temperature due to the inherent properties of the magnets themselves. Since the magnets provide flux for both the sensing coil and the damping coil, the effect of the magnet flux change comes into play twice in the damping feedback loop. Therefore, the change in the damping is twice the change in the magnetic flux density.

Because the temperature coefficient for most suitable magnetic materials is in the region of 10% as large as the resistance change of copper, the variation of damping with temperature is about 20% as large as previous eddy current damped devices. Practically all the remaining temperature dependent damping variation of the device disclosed herein is due to the temperature coefficient of the magnets. Using magnetic materials with lower temperature coefficients or temperature compensation magnetic circuits further improves the damping stability as will be apparent to those skilled in the art.

Another way to further improve the temperature related damping stability may be achieved by changing the gain of the amplifier 74 as a function of temperature utilizing thermistors in the amplifier feedback paths. For most application, the degree of stability achieved by the electronic damping scheme disclosed herein is adequate without other compensation for magnet flux changes.

As already mentioned, one advantage of the active damping system disclosed herein is the ease with which the damping can be varied by adjusting the amplifier gain. This gain adjustment can be done by physically changing a resistor in the amplifier or by the electronic equivalent. In the case of the electronic adjustment, an electronic signal from various sources can be inputted to the damping electronics to vary the damping in many desirable ways. For example, the gain and therefore the sensitivity of the device could be varied as a function of flight time or velocity or practically any function for which an electronic equivalent signal could be derived.

Another advantage of the active damping system disclosed herein is the ability to increase the dynamic range of the steering rate sensor 22. For example, for low input angular rates the damping could be low to allow high sensitivity. As the angular rates increase, the damping can be increased to prevent the armature member from hitting its travel limits. This can be done with an electronic feedback control loop. This loop can provide automatic gain control to the steering rate sensor drive electronics to maintain a nearly constant armature member displacement over a wide range of angular rate inputs. In order to allow the missile guidance computer to compute the angular rate from the angular rate sensor 22, both the sensing coil signal and a signal describing the instantaneous state of the gain in the automatic gain control stage is required to be inputted to the missile guidance computer. This computation could be done by a small computation circuit physically associated with the steering rate sensor 22, and then sent to the guidance computer as a single analog signal or a digital word.

The illustrated apparatus is preferably mounted within a rolling airframe, such as illustrated in FIG. 1, in a position for detecting steering rate in the control plane. The sensing coil and the damping coil are mounted on the armature. Since the entire steering rate sensor 22 rotates with the airframe, a gyroscopic effect is produced on the armature member, which in conjunction with the active damping control circuit stabilizes the position of the armature member. Therefore, a zero output is experienced by the sensing coil when the airframe is not experiencing any angular rates. However, when action of the control surfaces or other effects cause the airframe attitude to change in the control plane, the angular velocity of that steering movement determines the degree to which the armature member will precess. The precession of the armature member results in the induction of EMF forces within the sensing coil. The armature member oscillates about its pivot axis at the roll rate of the airframe. The amplitude of this oscillation is dependent upon the steering rate, the roll rate, the viscous damping, friction, magnetic coupling, air gap and the inertia. The AC signal induced into the sensing coil is dependent upon the number of coil turns, the gauss level, and the rate of the armature motion. If the direction of the steering rate is changed, the phase of the induced signal changes.

The electrical signal generated by this movement of the armature member may be utilized as a signal for controlling the autopilot control system of the airframe. The signal, if necessary, may be amplified to boost the signal amplitude. The system has only a single moving part, and the only electrical power required is that to operate small IC damping circuit electronics. No spin motors or demodulator electronics are required.

The equations of motion of the system are not believed to be essential to a complete understanding of the invention. These can be readily developed by those skilled in the art when considering the dynamics of the illustrated apparatus.

Friction will have an effect on the damping of the system and therefore must be accounted for in the system. The apparatus can be designed for specific revolutions per second in the roll rate of the airframe. Good bearing design and armature member balance about its rotary axis and about its pivot axis are essential to optimum performance. Balance about the rotary axis will avoid unequal loading of the bearings and balance about the pivot axis will preclude forcing one end of the armature member against the cover of the device during the acceleration phase of the flight. The steering rate sensor is designed to have a natural frequency that is equal to that of the roll rate. Viscous damping of the armature member is provided by means of the previously described electronic damping circuit and the damping coil.

The angular rate sensor herein described has a unique feature in that the sensing coil and the damping coil are independent of each other, both electrically and electromagnetically. That is to say the electromagnetic circuit is so configured to minimize the inductive and other magnetic couplings between the sensing coil and the damping coil. The advantages of reducing these couplings for maintaining system stability in a device which uses high gain feedback control circuits will be clear to those skilled in the art of control system design. Another unique feature toward this same goal of reducing magnetic coupling is that the magnets 30 are arranged with either all North or all South magnetic poles inward. This has the effect of making the magnetic circuits on both ends of the angular rate sensor independent of the other since no magnetic flux is exchanged between these magnetic circuits. Actually, the device need not use magnetically permeable material in the region of the housing and base which surround the pivot shaft.

Another advantageous feature of the angular rate sensor described herein is its long, thin armature member with massive portions at its opposite ends. The advantages of this configuration are increased armature member inertia and decreased overall armature member mass. These are both advantageous since one of the major contributors to sensor inaccuracy is pivot bearing friction. Increased inertia helps because the inertia provides the torque which drives the armature member. Lower rotor mass helps by lowering the axial and radial loads on the pivot bearings. The combination of higher inertia and lower mass tends to reduce the effects of bearing friction and therefore improve the sensitivity and linearity of the sensor at low angular rates while subject to missile accelerations.

The fact that the armature member has coils mounted therein which are moved through a magnetic field cause electrical current to be induced in the coils. This is an example of Lenz's Law which further indicates that the motion of the armature member will be opposed. The opposing force is proportional to the current induced and the magnetic field generated in the coils. This means that certain damping can or will be imposed on the armature by means of any metal within the vicinity of the armature member The performance of the device will also be affected by nearby magnetic materials.

The signal amplitude or output of the sensor 22 can be altered by a number of techniques, including the distance of the sensing coil from the adjacent magnets. Increasing the number of turns in the sensing coil will also increase the amplitude. Since a very small current will be induced in the sensing coil, the wire size may be quite small. The longitudinal length of the sensing coil is subject to peak-to-peak angular position of the armature member. The length of the sensing coil and the permissible swing of the armature member are preferably selected to maintain a more direct proportionality between the oscillations of the armature member and the induced signal. Using a sensing coil with many turns allows a lower gauss level with about the same signal amplitude.

The actively damped steering rate sensor described herein can be used in an autopilot control system to greatly enhance the performance and maneuverability of a missile or other rolling airframe.

While the present invention has been illustrated and described by means of a particular embodiment, it is to be understood that numerous changes and modifications may be made therein without departing from the spirit and scope of the invention as defined in the appended claims.

Having described our invention, we now claim:

1. An actively damped steering rate sensing device for an autopilot control system capable of producing angular rotation in a control plane of an intentionally continuously axially rolling airframe in response to a rotation related guidance command signal, the sensing device comprising:

an elongated armature member;

means for mounting the armature member to the airframe for pivotal movement about an axis extending through the armature member intermediate its length, the pivot axis being oriented with respect to the rotational axis of the airframe so that the armature member will pivot by gyroscopic precession in response to rotation in the control plane of the rolling airframe;

a sensing coil mounted on one end of the armature member;

a damping coil mounted on the other end of the armature member;

first magnetic means adjacent the one end of the armature member for causing an output signal to be induced in the sensing coil upon pivotal movement of the armature member; and second magnetic means adjacent the other end of the armature member for causing pivotal movement of the armature member to be inhibited upon application of a damping signal to the damping coil.

2. The invention of claim 1 and further comprising:

circuit means for receiving the output signal, generating the damping signal therefrom, and applying the damping signal to the damping coil.

3. The invention of claim 2 wherein the circuit means includes at least one current amplifier.

4. The invention of claim 2 wherein the amplitude of the damping signal is directly proportional to the amplitude of the output signal.

5. The invention of claim 2 wherein the circuit means includes means for varying the instantaneous amplitude of the damping signal generated from the output signal.

6. The invention of claim 3 wherein the circuit means further includes means for adjusting the gain of the amplifier.

7. The invention of claim 3 wherein the circuit means further includes means for automatically adjusting the gain of the amplifier as a function of temperature.

8. The invention of claim 7 wherein the gain adjust means includes a thermistor coupled in a feedback path of the amplifier.

9. The invention of claim 2 wherein the circuit means includes:

first amplifier means for amplifying the output signal and feeding it to the autopilot control system; and second amplifier means connected to the output of the first amplifier means for generating the damping signal.

10. The invention of claim 3 wherein the circuit means further includes means for increasing the gain of the amplifier in response to increasing amplitude of the output signal.

11. The invention of claim 1 and further comprising a cover made of magnetically permeable material enclosing the armature member, coils and magnetic means.

12. The invention of claim 1 wherein the armature member has a cut out in each end, the coils are mounted in respective ones of the cut outs, and the magnetic means includes a pair of magnets fixedly mounted adjacent corresponding ends of the armature member and a pair of flux return path elements fixedly mounted adjacent corresponding ones of the magnets and extending through respective ones of the coils, the ends of the armature member and the coils being capable of free up and down movement with respect to the return path portions upon pivotal movement of the armature member.

13. The invention of claim 1 and further comprising:

first means for balancing the armature member with respect to its pivotal axis; and second means for balancing the armature member about the rotational axis of the airframe.

14. The invention of claim 2 wherein the circuit means causes the damping signal to be applied to the damping coil with a predetermined phase with respect to the output signal so as to damp the pivotal motion of the armature member.

15. The invention of claim 14 wherein the phase is 0° or 180°.

16. The invention of claim 3 wherein the circuit means includes means for automatically adjusting the gain of the amplifier as a function of the flight path.

* * * * *

UNITED STATES PATENT AND TRADEMARK OFFICE

CERTIFICATE OF CORRECTION

PATENT NO. : 5,035,376

DATED : July 30, 1991

INVENTOR(S) : ALLAN A. VOIGT, ET AL.

It is certified that error appears in the above-identified patent and that said Letters Patent is hereby corrected as shown below:

Title page, item [22], "Jul. 31, 1981" should read --July 13, 1981--.

Signed and Sealed this

Ninth Day of March, 1993

*Attest:*

STEPHEN G. KUNIN

*Attesting Officer*

*Acting Commissioner of Patents and Trademarks*